United States Patent [19]

Runnels et al.

[11] 4,392,015

[45] Jul. 5, 1983

[54] CONDENSER-TYPE ELECTRICAL BUSHING WITH CENTRAL ELECTRODE ALIGNING WEDGING BLOCKS

[75] Inventors: Robert W. Runnels, Milwaukee, Wis.; Loren B. Wagenaar, Muncie, Ind.; Louis E. Luke, Mt. Pleasant Township, Delaware County, Ind.; Thomas P. Bresnahan, Muncie, Ind.

[73] Assignee: Westinghouse Electric Corp., Pittsburgh, Pa.

[21] Appl. No.: 327,648

[22] Filed: Dec. 4, 1981

[51] Int. Cl.[3] ..... H01B 17/28

[52] U.S. Cl. ..... 174/143; 174/31 R

[58] Field of Search ..... 174/12 BH, 31 R, 143

[56] References Cited

U.S. PATENT DOCUMENTS 1,751,379 3/1930 Allan ..... 174/31 R

*Primary Examiner*—Laramie E. Askin

*Attorney, Agent, or Firm*—L. P. Johns

[57] ABSTRACT

The present invention is a condenser-type electrical bushing having a mounting flange, an upper weather casing connected to the mounting flange, a central electrode and a lower casing, both supported by the upper weather casing. A condenser is wound about the central electrode. The bushing further has a plurality of wedging blocks which are rigidly connected to the condenser and located above the mounting flange such that upon mechanical failure of the upper weather casing the central electrode and the condenser are prevented from falling into the electrical apparatus.

3 Claims, 3 Drawing Figures

CONDENSER-TYPE ELECTRICAL BUSHING WITH CENTRAL ELECTRODE ALIGNING WEDGING BLOCKS

BACKGROUND OF THE INVENTION

1. Field of the Invention

This invention is related generally to condenser-type bushings used on high-voltage electrical equipment and more specifically to a means for securing the condenser portion of the bushing.

2. Description of the Prior Art

High-voltage electrical equipment requires a through electrical connector to connect the internals of the equipment to the outside world. For decades electrical bushings have provided this connection. Bushings are well known and their characteristics well understood in the prior art.

An electrical apparatus typically has an opening in its shell, casing, or tank. This opening is provided with a means for cooperating with a mounting flange of a bushing. A typical bushing has, in addition to the mounting flange, an upper weather casing and a lower casing. The upper weather casing is connected to the mounting flange such that the upper weather casing extends outwardly from the electrical apparatus. An upper electrical connector is located at the far end of the upper weather casing for connection to high-power transmission lines or the like. The lower casing of the bushing extends inwardly into the electrical apparatus and has a lower electrical connector located at one end for connection to electrical windings or the like inside the electrical apparatus. A central electrode is supported by the upper weather casing and connects the upper electrical connector and the lower electrical connector thus providing an electrical path between the outside world and the internals of the electrical apparatus. The central electrode supports the lower casing.

The central electrode is at a high-voltage potential and carries large electrical currents producing a strong electric field. In contrast, the shell of the electrical apparatus is at ground potential. Since the central electrode is in close physical proximity to the grounded shell there exists a large potential gradient therebetween. The central electrode of some types of bushings is wound with oil-impregnated paper having metallic foils at regular intervals thus producing a plurality of capacitors serially connected. The capacitors uniformly distribute the electrical stresses throughout the insulating structure of the bushing, preventing stress concentrations which can cause a discharge or flashover from the central electrode to the grounded shell. Such bushings are called capacitor or condenser bushings.

In the typical condenser bushing problems are encountered should the upper weather casing fail mechanically due to high winds, lightning strokes, a hunter's bullet, etc. Upon mechanical failure of the upper weather casing the lower casing, together with the central electrode and the condenser, may fall into the electrical apparatus. The central electrode and the condenser, being very heavy, will cause impact damage to the electrical apparatus mounted below it and will disrupt the carefully balanced electric field. This damage and field distortion may ultimately cause the electrical apparatus to fail.

Several schemes for preventing the central electrode and the condenser from falling into the electrical apparatus are known. One method is to connect the lower casing directly, and independently, to the mounting flange. Utilizing this method it becomes necessary for both the upper weather casing and the lower casing to fail before the central electrode and the condenser will fall into the electrical apparatus.

A second method is to connect the condenser directly to the mounting flange or a supporting bracket. The central electrode and condenser are thus supported independently of the upper and/or lower casings.

A third method is to wind the condenser such that its outside diameter at a point above the mounting flange is larger than the inside diameter of the mounting flange thereby preventing it from falling into the electrical apparatus.

All three of the above-mentioned methods require some modification of the typical bushing and condenser arrangement discussed above wherein the upper weather casing supports the central electrode, the lower casing and the condenser. The present invention is intended for use on the typical bushing and condenser arrangement and provides for wedging the condenser within the mounting flange such that the central electrode and the condenser will not fall into the electrical apparatus even upon failure of the upper weather casing. The present invention requires no modification of the typical bushing and condenser arrangement or of the mounting flange such as is required by the prior art arrangements discussed above. The present invention may therefore be implemented on existing bushings and electrical equipment.

SUMMARY OF THE INVENTION

The present invention is intended for use on a typical condenser-type bushing having a mounting flange, an upper weather casing supporting both a central electrode and a lower casing, and a condenser which is wound about the central electrode. Wedging blocks are used to wedge the condenser into the mounting flange of the bushing such that upon mechanical failure of the upper weather casing the central electrode and the condenser will not fall into the electrical apparatus.

DESCRIPTION OF THE PREFERRED EMBODIMENT

Figure 1:
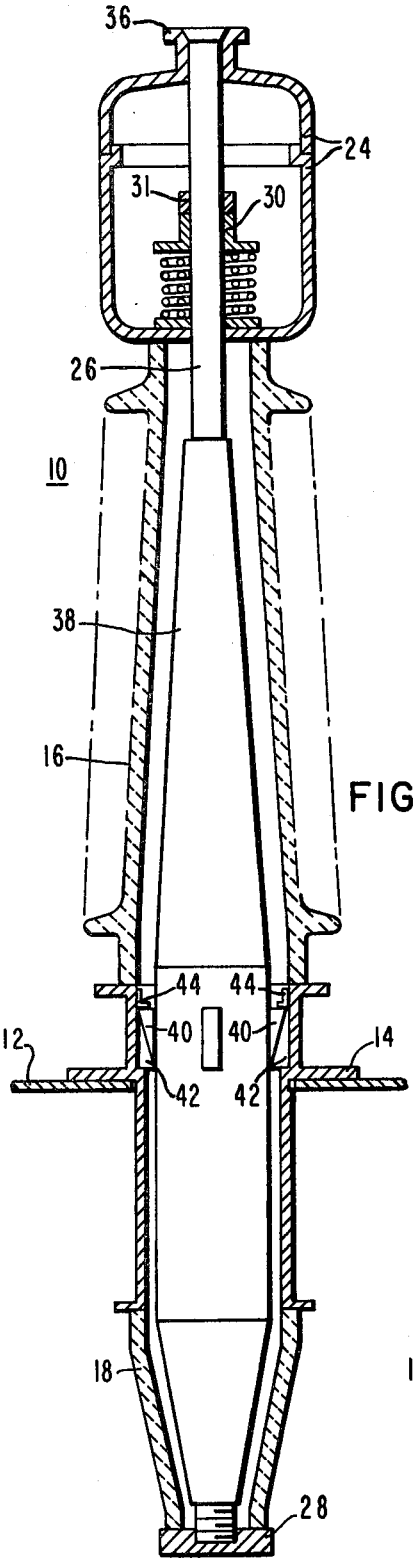
FIG. 1 is a vertical sectional view illustrating a typical bushing utilizing the present invention.

A typical condenser-type electrical bushing 10 is shown in FIG. 1. The bushing 10 is used as a through electrical connector for an electrical apparatus having an outer shell 12. The outer shell 12 has an opening through which the bushing 10 extends. The bushing 10 is made up generally of a mounting flange 14, an upper weather casing 16, and a lower casing 18. The casings 16 and 18 are typically made of porcelain, epoxy, or other insulating materials. The upper weather casing 16 is fixed, and sealed through a gasket (not shown), to the mounting flange 14. The upper weather casing 16 is also fixed, and sealed through a gasket (not shown), to an expansion cap 24.

A central electrode 26 extends through both the upper weather casing 16 and the lower casing 18. The central electrode is connected at its lowermost extremity to a support fitting 28. The support fitting 28 is also used as a terminal fitting for connection to the internals of the electrical apparatus. The central electrode 26 has a spring keeper plate 30 attached near its uppermost extremity by a spanning nut 31. A spring is located between the lower wall of the upper expansion cap 24 and the spring keeper plate 30. The upper weather casing 16 supports the central electrode 26. The central electrode 26 together with the support fitting 28 supports the lower casing 18. The spring causes both the upper weather casing 16 and the lower casing 18 to impart a compressive force against the mounting flange 14. A gasket (not shown) located between the lower casing 18 and the mounting flange 14 maintains a sealed relationship therebetween.

The central electrode 26 is connected to a top terminal 36. The top terminal 36 may be connected to a terminal cap (not shown) or the like for connection to high-power distribution lines.

The central electrode 26 has a condenser section 38 wound therearound. The condenser section 38 is wound such that its outside diameter does not exceed the inside diameter of the mounting flange 14. A plurality of triangular wedging blocks 40 are rigidly attached around the outside diameter of the condenser section 38. A plurality of triangular wedging blocks 42 are supplied into guides (not shown) located around the inside diameter of the mounting flange 14. Each of the triangular wedging blocks 42 cooperates with one of the triangular wedging blocks 40. A plurality of locking straps 44 secure the triangular wedging blocks 40 to the mounting flange 14.

The wedging blocks 40 and 42 perform several functions. First, the wedging blocks 40 and 42 are used to center the condenser section 38 within the mounting flange 14. Second, during assembly the condenser section 38 can be rotated a few degrees after fastening of the locking straps 44 due to the flexibility of the locking straps and the ability of the triangular wedging blocks 40 to move relative to the triangular wedging blocks 42. This slight rotation may be useful in obtaining a proper alignment of the condenser section 38 within the mounting flange 14. The ability of the wedging blocks 40 to move relative to the wedging blocks 42 and the flexibility of the locking straps 44 allows the condenser section 38 to move axially relative to the flange 14. This allows for small axial movements during shipping and helps prevent the tearing of the triangular wedging blocks 40 from the condenser section 38. The axial movement of the condenser section 38 relative to the mounting flange 14 will be restricted to one direction when the triangular wedging blocks 40 are in contact with the triangular wedging blocks 42. Finally, when a downward force is exerted on the condenser section 38, the geometry of the triangular wedging blocks 40 and 42 is such that a compressive radial force is exerted on the triangular wedging blocks 40 and 42. This force will increase the frictional force between the triangular wedging blocks 40 and the condenser section 38 thus increasing the withstand capability of the bond therebetween. In the event that the upper weather casing 16 fails mechanically, the triangular wedging blocks 40 and 42 will prevent the central electrode 26 and the condenser section 38 from falling into the electrical apparatus.

The triangular wedging blocks 40 and 42 shown in FIG. 1 typically have a length of seven inches (17.78 cm), a width of two inches (5.08 cm), and a height of one and five eights inches (4.12 cm). In the preferred embodiment eight pairs of triangular wedging blocks 40 and 42 are equally spaced around the outside diameter of the condenser section 38. The triangular wedging blocks 40 and 42 may be made from any suitable non-conductive material, such as pressboard or Micarta. The locking straps 44 may be made of any suitable material, conductive or non-conductive. The numbers and dimensions given herein are for purposes of illustration and not limitation since the actual number of wedging blocks used, and their dimensions, will vary depending upon the weight which must be supported.

Figure 2:
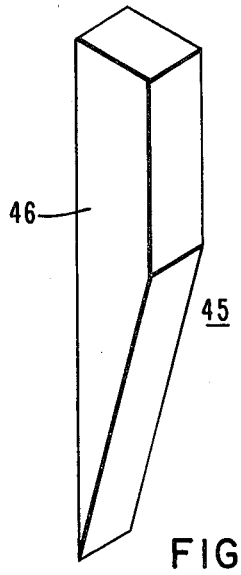
FIG. 2 is a perspective view of one type of wedging block.

Variations of the geometry of the wedging blocks 40 and 42 are anticipated. A perspective view of one such variation is shown in FIG. 2. FIG. 2 illustrates a wedging block 45 having an extended length, the extension 46 having the geometry of a rectangular parallelpiped. The extension 46 provides additional surface area for bonding or for the attachment of banding straps (not shown) or the like.

Figure 3:
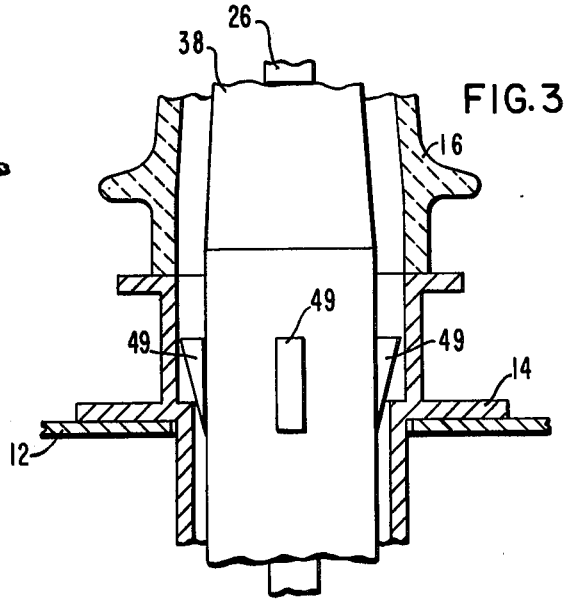
FIG. 3 is a fragmentary vertical sectional view, illustrating an alternative embodiment of the present invention.

An alternative embodiment of the present invention is shown in FIG. 3. Identical components performing identical functions have the same reference numerals. A plurality of triangular wedging blocks 49 are rigidly attached around the outside diameter of the condenser section 38. The combination of the outside diameter of the condenser section 38 and the triangular wedging blocks 49 is larger than the inside diameter of the mounting flange 14 thus preventing the condenser section 38 and the central electrode 26 from falling into the electrical apparatus upon failure of the upper weather casing 16.

What is claimed is:

1. A condenser bushing for electrical apparatus, comprising:

a cylindrical mounting flange having a predetermined inside diameter;

an upper casing connected to the mounting flange;

a lower casing coaxially positioned with said upper casing;

a central electrode positioned within said upper and said lower casings, said electrode being supported by said upper casing, said electrode supporting said lower casing;

a condenser section wound about said central electrode, said condenser section having an outside diameter that is smaller than the inside diameter of said mounting flange; and means for centering said condenser section within said mounting flange, said means including a plurality of triangular wedging blocks, said means being rigidly attached to said condenser section such that the combination of said outside diameter of said condenser section and said means for centering is larger than said inside diameter of said mounting flange thus preventing said condenser section and said central electrode from falling into the electrical apparatus upon mechanical failure of said said upper casing.

2. The condenser bushing of claim 1 wherein the means for centering includes a plurality of pairs of triangular wedging blocks.

3. The condenser bushing of claim 2 including straps for rigidly attaching the plurality of wedging blocks to the mounting flange, said straps limiting the rotational and axial movement of the condenser relative to said mounting flange.

* * * * *